US006178954B1

(12) United States Patent
Kim

(10) Patent No.: US 6,178,954 B1
(45) Date of Patent: Jan. 30, 2001

(54) DEVICE FOR REDUCING TOXIC WASTES OF DIESEL FUEL

(76) Inventor: Sang Kyeong Kim, 330-280, Hongjae-1dong, Seodaemon-ku, Seoul 120-091 (KR)

( * ) Notice: Under 35 U.S.C. 154(b), the term of this patent shall be extended for 0 days.

(21) Appl. No.: 09/331,977

(22) PCT Filed: Dec. 6, 1997

(86) PCT No.: PCT/KR97/00259

§ 371 Date: Aug. 26, 1999

§ 102(e) Date: Aug. 26, 1999

(87) PCT Pub. No.: WO99/23382

PCT Pub. Date: May 14, 1999

(30) Foreign Application Priority Data

Oct. 30, 1997 (KR) ..... 97/56566

(51) Int. Cl.[7] ..... F02M 33/00
(52) U.S. Cl. ..... 123/538
(58) Field of Search ..... 123/538, 537, 123/536; 210/695, 222

(56) References Cited

U.S. PATENT DOCUMENTS

| | | | | |
|---|---|---|---|---|
| 5,243,946 | * | 9/1993 | Dalupan | 123/538 |
| 5,329,910 | * | 7/1994 | Tanaka | 123/538 |
| 5,329,911 | * | 7/1994 | Jeong | 123/538 |
| 5,460,144 | * | 10/1995 | Park et al. | 123/538 |
| 5,632,254 | * | 5/1997 | Kim | 123/538 |

FOREIGN PATENT DOCUMENTS 2 281 351 1/1995 (GB) .

OTHER PUBLICATIONS

Automobile Engineering, Won Sup Bae, 1992—Dongmyung Publication Co. pp. 222–230.

Diesel Engine, Eung Suh Kim, 1966—Semoon Publication Co., pp. 367–370.

Automobile Engine II Diesel Engine, Jae Hwi Kim 1997—Choongwon Publication Co. pp.442–444.

* cited by examiner

*Primary Examiner*—Willis R. Wolfe
*Assistant Examiner*—Hydek Ali
(74) *Attorney, Agent, or Firm*—Finnegan, Henderson, Farabow, Garrett & Dunner, L.L.P.

(57) ABSTRACT

This invention relates to a device for reducing toxic wastes of diesel fuel and more particularly, to a novel-type device for reducing toxic wastes of diesel fuel. The device of this invention, being equivalent to a pre-treatment device, is mounted to the surface side of a fuel feed port at a diesel internal combustion engine so as to activate molecules in diesel fuel and their molecular movement. In particular, with a view to effective induction of electromagnetic wave and magnetic field, some supplemental equipments such as magnet, ceramic pole and coil are arranged on the device of this invention and based on this fabrication, perfect combustion conditions of diesel fuel may be provided in such a manner that some physicochemical changes are offered to diesel fuel, passing through the fuel feed port. Thus, the device of this invention has advantages in that a) after diesel combustion, the release of toxic substances in exhaust gas may be significantly inhibited, and b) fuel consumption may be further improved.

9 Claims, 6 Drawing Sheets

DEVICE FOR REDUCING TOXIC WASTES OF DIESEL FUEL

BACKGROUND OF THE INVENTION

1. Field of the Invention

This invention relates to a device for reducing toxic wastes of diesel fuel and more particularly, to a novel-type device for reducing toxic wastes of diesel fuel. The device of this invention, being equivalent to a pre-treatment device, is mounted to the surface side of a fuel feed port at a diesel internal combustion engine so as to activate molecules in diesel fuel and their molecular movement. In particular, with a view to effectuate induction of electromagnetic wave and magnetic field, some supplemental equipment such as a magnet, ceramic pole and coil are arranged on the device of this invention and based on this fabrication, perfect combustion conditions of diesel fuel may be provided in such a manner that some physicochemical changes are offered to diesel fuel, passing through the fuel feed port. Thus, the device of this invention has advantages in that a) after diesel combustion, the release of toxic substances in exhaust gas may be significantly inhibited, and b) fuel consumption may be further improved.

2. Description of the Prior Art

A process of forming toxic substances from exhaust gas of diesel fuel is summarized as follows: when combustion from a diesel engine is under way, air and diesel fuel are partially mixed during their reaction. The reaction between air and diesel fuel is carried out in a series of sequential processing steps—mixed gas formation, ignition, combustion and explosion—that influence each other. In this context, since the concentration ratio of mixed gas and air is not constant, combustion occurs at one point, while a heating process, such as vaporization, is performed at another point in the process.

When heating some rich areas in the reaction band of both diesel fuel and air, the reaction is carried out from vapor pocket at the surface of fuel particles and then carbon particles from the hydrocarbons are isolated. If the ignition of isolated carbon particles is blocked by such reaction, the particles are released into air in the form of soot without combustion. Some gaseous toxic wastes including soot are released together with CO, HC, NOx and SOx. In particular, since combustion in a diesel engine does not occur in the presence of excessive air, the amount of CO released is not serious but non-firing hydrocarbons generated from a low-load and/or cold driving have imposed serious problems to the environment.

As such, some particle substances released from diesel engine are environmental contaminants; for example, the soot may irritate eyes and have a bad odor, among other things. Further, while still in dispute, the aromatic hydrocarbons absorbed in the soot may affect the human body. At any rate, if the soot is inhaled into the human's respiratory tract, undesirable effects may occur.

When some problems associated with normal and abnormal combustion from a diesel engine are reviewed mechanically and chemically, the combustion from a diesel engine occurs in such a manner that, unlike a gasoline engine, the injection of diesel fuel continues for a certain period. Thus, the intervals of fuel injection will significantly affect some fuel combustion. In general, a diesel engine is characterized in that, through a compression stroke of air, injected fuel within a cylinder is formed into an appropriately mixed gas and ignited spontaneously. Thus, several flame nuclei are simultaneously formed, while the combustion occurs throughout the cylinder.

FIG. 1 contains a graph showing the combustion process of a diesel engine. When diesel fuel is injected at "A" point, an ignition lag occurs between points "A" and "B", normally an extremely short time due to heating and chemical change. Hence, if the ignition lag is long, the maximum explosion pressure is high, as illustrated in FIG. 2. If the ignition lag is, on the contrary, short, the injection fuel is slowly fired in the sequential order of injection. Then, since the pressure within the cylinder builds slowly, the highest explosive force is maintained by the pressure formed within a cylinder. Therefore, if the ignition lag is short, a maximum explosion pressure is lower than FIG. 2, as shown in FIG. 3.

Since diesel fuel within a diesel engine is fired under constant pressure, a slow combustion process is required. If diesel fuel having a long ignition lag is employed, the drastic combustion causes a diesel knock phenomenon under the reversed constant-pressure combustion. Since an explosive pressure is rapidly enhanced simultaneously with ignition between "B" and "C" illustrated in FIG. 1, diesel fuel accumulated between "A" and "B" is continuously exploded simultaneously with ignition. This is a change corresponding to the basic-cycle static combustion and cannot be regulated by any other method from the outside.

Since the pressure and temperature within a combustion chamber may adequately reach the necessary levels between "C" and "D" as illustrated in FIG. 1, injected diesel fuel is fired in a sequential order of injection and the process is maintained in nearly constant pressure. However, if such period gets much longer, the cut-off ratio of diesel fuel becomes enlarged and its thermal efficiency lowered. In order to ensure the maximum efficiency with high output within a limited cylinder, it is considered that the maximum combustion effects should be fulfilled by a minimum amount of excessive air with an appropriate mixing ratio of injection fuel, atomization and air.

Further, some remaining fuel, which has not been fired at the point of "D" illustrated in FIG. 1, maintains the after-burning state but this is of little help in that such fuel increases the temperature of combustion exhaust and blackens the color of exhaust gas. Such phenomenon occurs because diesel fuel having a long ignition lag is used and there is an accumulation phenomenon with the fixed fuel valve reopened.

As mentioned above, diesel knock is not responsible for thermal damages due to abnormal heat transmission but a sharp fluctuation in torque may not provide any quiet driving and also, there is a risk that its impact will result in causing an excessive stress (Automobile Engineering, Won Sup Bae, 1992, Dongmyung Publication Co., pp. 222–230; Diesel Engine, Eung-Suh Kim, 1996, Semoon Publication Co., pp. 367–370; Automobile Engine II diesel engine, Jae-Hwi Kim, 1997, Choongwon Publication Co., pp. 442–444.).

Unlike a gasoline engine, a diesel engine has an unclear limitation on the diesel knock phenomenon which may be underestimated. Basically, it is possible to avoid the diesel knock with a short ignition lag. As such, since the ignition lag causes diesel knock, it is imperative that to prevent such phenomenon, diesel fuel having better ignition property should be used and, otherwise, proper alternatives be instituted.

To overcome the combustion related problems associated with a diesel engine, such factors as compression ratio and suction/ cylinder temperature should be considered. Hence, it is preferred that the temperature of compression and suction is higher, since this means that higher compression is given to the air inhaled into a combustion chamber.

Under such state, the fluidity of air intake and proper time of injecting diesel fuel should be determined. A swirling or turbulent flow of air-intake will facilitate the chemical reaction during the mixing process. Moreover, if an air-intake temperature is high, vaporization of diesel fuel is increased which helps to atomize the injected diesel oil, thus shortening the ignition lag. Also, if the injection period of fuel is determined as a top dead center, its mean temperature and pressure are maximized so that the ignition lag is further shortened.

However, since a machine has a limit, the mechanical limit should be necessarily overcome by shortening the ignition lag period through proper control of appearance or nature of the diesel fuel. The ignition lag period is one of the critical problems affected by diesel fuel. At this point, with reference to the appearance and nature of diesel fuel, including the process of atomization and dispersion, the possible notion is that since diesel fuel having higher firing temperature is responsible for longer ignition lag, diesel fuel of many cetane numbers should be used, and atomized dispersion should be mechanically considered so that injected fuel is in broad contact with high-temperature air. In addition, the following regulation method is considered in solving the problems associated with the properties of diesel fuel in terms of its physicochemical causes.

First, when the viscosity of diesel fuel is reviewed, the viscosity of hydrocarbons is enhanced proportionately with the increase of carbon numbers. If the carbon numbers are the same, the viscosity of naphthene series is higher than that of olefin or paraffin series. In general, if the boiling point of diesel fuel is low, its viscosity is also low. Also, the viscosity of diesel fuel has a close relationship with atomization; if the viscosity of diesel fuel is low, its enhanced dispersing property and particulated dispersion facilitate the heating and vaporization, thus shortening the ignition lag and improving the combustion. However, if the viscosity of diesel fuel is extremely low, its weak through-force within a combustion chamber results in losing the homogenous distribution of diesel fuel within a cylinder and a poor contact with air is also responsible for inhomogeneous combustion. In addition, a poor lubrication is caused by an injection pump or injection nozzle and there is a high risk on the leakage of diesel fuel. In contrast, if the viscosity of diesel oil is much higher, the residues are accumulated on the internal engine, thus generating smoke and bad odors.

In case of diesel fuel having varying viscosity in terms of its nature, a fuel temperature should be maintained at a certain level. Therefore, it is generally stipulated that the viscosity of diesel fuel be 2~5.8 $nwl^2/s$ at 30° C. or 37.8° C. Nevertheless, as mentioned above, it is imperative that diesel oil should be provided with the following conditions, such as guaranteed through-force, better dispersion and enhanced particulation.

Second, diesel fuel should have better ignition property so as to ensure normal combustion without diesel knock in a diesel engine. In general, a cetane number is mentioned for specifying the firing property. It is stipulated that the cetane number of a high-speed diesel engine fuel be more than 45 at minimum. If any diesel fuel has many cetane numbers, better improved starting point contributes to more efficient driving. However, if any diesel fuel has a great number of cetanes, there will be larger portion occupied by normal paraffin-based hydrocarbons and then, lower density and viscosity will be responsible for a weak penetration of injected fuel, thus resulting in imperfect combustion.

Third, with reference to the formation of soot, there is an increasing trend for soot release, when diesel fuel has a more compact molecular structure. Namely, the trend for soot release becomes higher in the sequential order of paraffin, naphthene and aromatic series.

As shown in the following chemical formula 1, normal paraffin has a hydrocarbon-bonded linear chain type (direct chain type) with a molecular formula of $C_nH_{2n+2}$.

Chemical formula 1

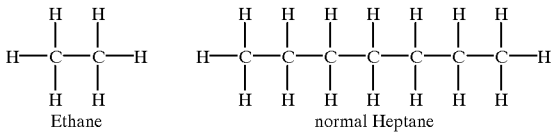

Also, as shown the following chemical formula 2, naphthene series consist of ring-shaped and single-bonded hydrocarbons structure with a molecular formula of $C_nH_{2n}$. Its structure is chemically stable since there is no double bonding.

Chemical formula 2.

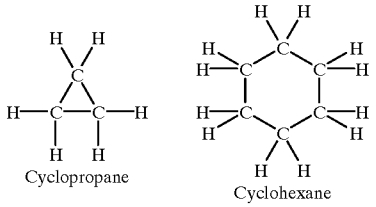

Further, as shown the following chemical formula 3, aromatic series consist of ring-shaped and double-bonded hydrocarbons structure. Its basic structure is a three-double bonded benzene ring with 6 carbon atoms. Several other molecules may be bonded to benzene ring, while its ignition property is low and anti-knock is strong.

Chemical 3.

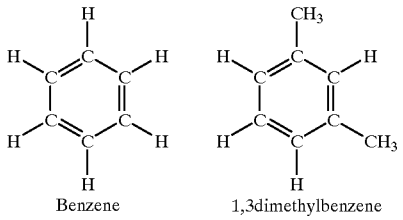

As noted in the above chemical formulae 1, 2 and 3, it is assumed that the molecular structure of carbon may be a factor in producing the soot during the combustion of diesel fuel.

Further, the majority of solid particle substances of diesel fuel released by combustion is in the range of about 0.01–10 $\mu$m in diameter. Thus, some solid particle substances of soot whose mean mass has a particle size of less than 1 $\mu$m in diameter should be separated prior to combustion, the appearance of diesel fuel should be also controlled. As observed from the above results, the formation of such solid particle substances is due to the chemical reaction of hydrocarbons.

In the meantime, with reference to some hydrocarbon of diesel fuel similar to that of the chemical formula 2 and chemical formula 3, carbon particles from the hydrocarbon are isolated during heating reaction in a pocket at the surface of fuel particles and when the reaction is continuously made, the combustion of these carbon particles are blocked and non-firing carbon particles are released into air in the form of soot. With carbon particles isolated, the blocked combustion of isolated carbon particles may be explained by the above mentioned facts but another factor is that among the ring-shaped hydrocarbons, molecular structures of the chemical formulae 2 and 3, hydrogen is isolated only when double-bonded molecular structure of carbon is not degraded; then, due to various reasons, such as combustion in insufficient oxygen during combustion and operating conditions of internal diesel engine, some solid particle substances are formed and released in the form of soot.

As aforementioned, any possible hypothesis based on viscosity, firing property and formation of soot is that to comply with some conflicting problems of diesel fuel, better injecting property should be provided and at the same time, its ignition property is higher; in addition, some solid particle substances generated by diesel fuel should be eliminated.

In light of the aforementioned aspects, the following matters should be considered so as to reduce the formation of soot from a diesel internal combustion engine and to improve the combustion efficiency intended for saving fuel consumption.

First, it is a dry air inhaled from the atmosphere to a diesel engine. Namely, the chemical composition of dry air comprises 78 vol % (75 wt %) of nitrogen ($N_2$) and 21 vol % (23.2 wt %) of oxygen ($O_2$). When dry air including nitrogen and oxygen is inhaled into a cylinder and compressed under higher pressure, some measures should be taken to have oxygen immediately react with diesel fuel under vaporization of hydrocarbons for oxidation thereof, without having the oxygen reacting with the nitrogen.

Second, some proper measures should also be established when hydrogen is isolated from carbon, in order that a) vaporized hydrocarbon may be reacted with oxygen, and b) perfect combustion may be made available by proper reaction among hydrogen, carbon and oxygen.

Therefore, this inventor has made extensive studies to overcome the above several problems and completed this invention which may inhibit the release of gaseous toxic wastes and particulated toxic wastes and at the same time, may improve the fuel consumption. This invention is characterized in that a) to improve combustion conditions of diesel fuel when supplied from a fuel tank to a fuel feed hose or pipe, lots of hydrocarbons (a mixture of hydrocarbons having about 10~20 carbons boiled at about 170~370° C.) in the diesel fuel are induced by an electromagnetic regulation method to achieve a molecular nature that is nearly adequate for perfect combustion, b) for further effective combustion, oxygen in the inhaled and compressed air is controlled by an electromagnetic regulation method from an air intake hole, c) under excess of air, solidified particle carbons owing to insufficient oxygen, and d) carbons may be sufficiently reacted with oxygen in any reaction band.

SUMMARY OF THE INVENTION

Therefore, the device of this invention is a conventionally unknown novel structure and an object of this invention is to provide a device for reducing toxic wastes of diesel fuel intended for improving the combustion conditions of diesel fuel, when it is installed, as a pre-treatment device of combustion, at some place adjacent to a fuel tank at the surface of inlet hose or pipe of diesel fuel.

Figure 1:
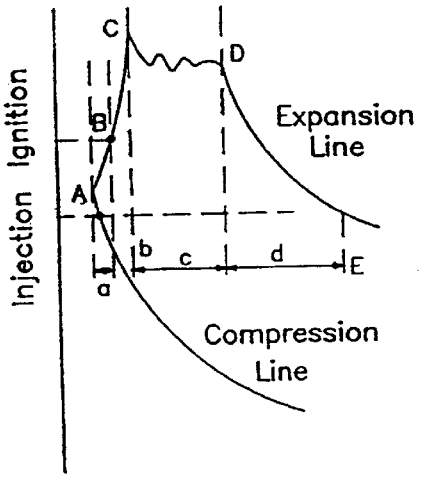
FIG. 1 is a graph showing a combustion process of a diesel engine.
Figure 1:
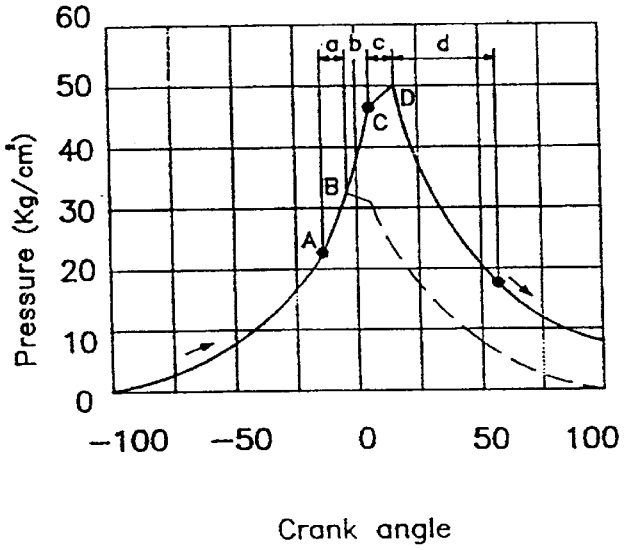
Figure 2:
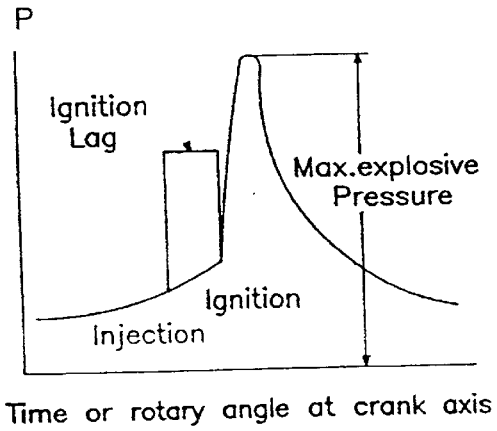
FIG. 2 is a graph showing the correlation between ignition lag of a diesel engine and its explosive pressure.
Figure 3:
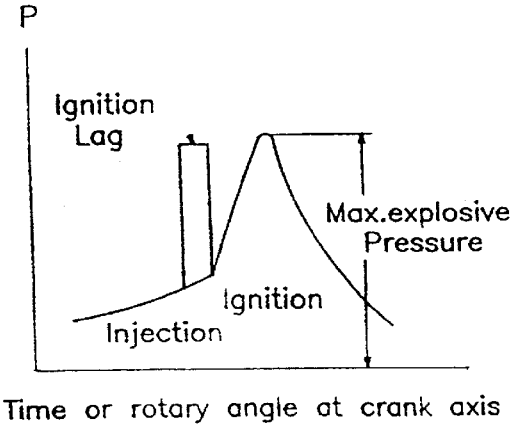
FIG. 3 is a graph showing the correlation in another state of FIG. 2.

<Denote on codes specified in the main parts of the drawings>

| | |
|---|---|
| 1 - Rubber band body | 2 - Copper sheet |
| 3 - Aluminum sheet | 4a, 4b - Rubber sealant |
| 5a, 5b, 5c - Magnetic induction pin | 6a, 6b, 6c - Magnet |
| 7a, 7b - Ceramic triangle pole | 8, 31 - Coil |
| 9 - Induction pin | 10 - Aluminum pipe |
| 11 - Insulator | 12a, 12b, 12c - Hole |
| 13 - Sealant | 20 - Air intake portion |
| 21 - Air intake hole | 22 - Combustion chamber |
| 23 - Air cleaner | 24 - Air intake manifold |

DETAILED DESCRIPTION OF THE INVENTION

This invention is explained in more detail as set forth hereunder by referring to the accompanied drawings.

This invention relates to a device for reducing toxic wastes of diesel fuel, comprising a copper sheet 2 and aluminum sheet 3 piled on a rubber body 1 in a sequential order; a pair of hexahedral rubber sealants 4*a*, 4*b* attached to left and right top sides of an internal upper side of the body 1; a plurality of channel-type magnetic induction pins 5*a*, 5*b*, 5*c* with upper sides opened being installed in the center and inner parts connected to the rubber sealants 4*a*, 4*b*; a plurality of magnets 6*a*, 6*b*, 6*c* installed within the magnetic induction pins; a plurality of ceramic triangle poles 7*a*, 7*b* connected among the magnetic induction pins 5*a*, 5*b*, 5*c*; and an electromagnetic wave induction pin 9 containing a coil 8 attached to a center selected from the ceramic triangle poles 7*a*, 7*b*; wherein the body 1 is inserted into a square aluminum pipe 10, while the external side of a pipe 10 is coated with an insulator 11.

Hence, reference numbers 12*a*, 12*b*, 12*c* (shown in FIG. 5) denote holes formed in the ceramic triangle poles 7*a*, 7*b*; reference number 13 denotes a sealant for sealing the aluminum pipe 10; reference number 20 denotes an air intake portion where air is inhaled into a diesel internal combustion engine; reference number 21 denotes an air intake hole in the air intake portion 20; reference number 22 denotes a combustion chamber, reference number 23 denotes an air cleaner; reference number 24 denotes an air suction manifold; reference number 31 denotes a pulse wave-generating coil installed in the air intake hole 21.

This invention is explained in more detail as set forth hereunder.

Figure 4A:
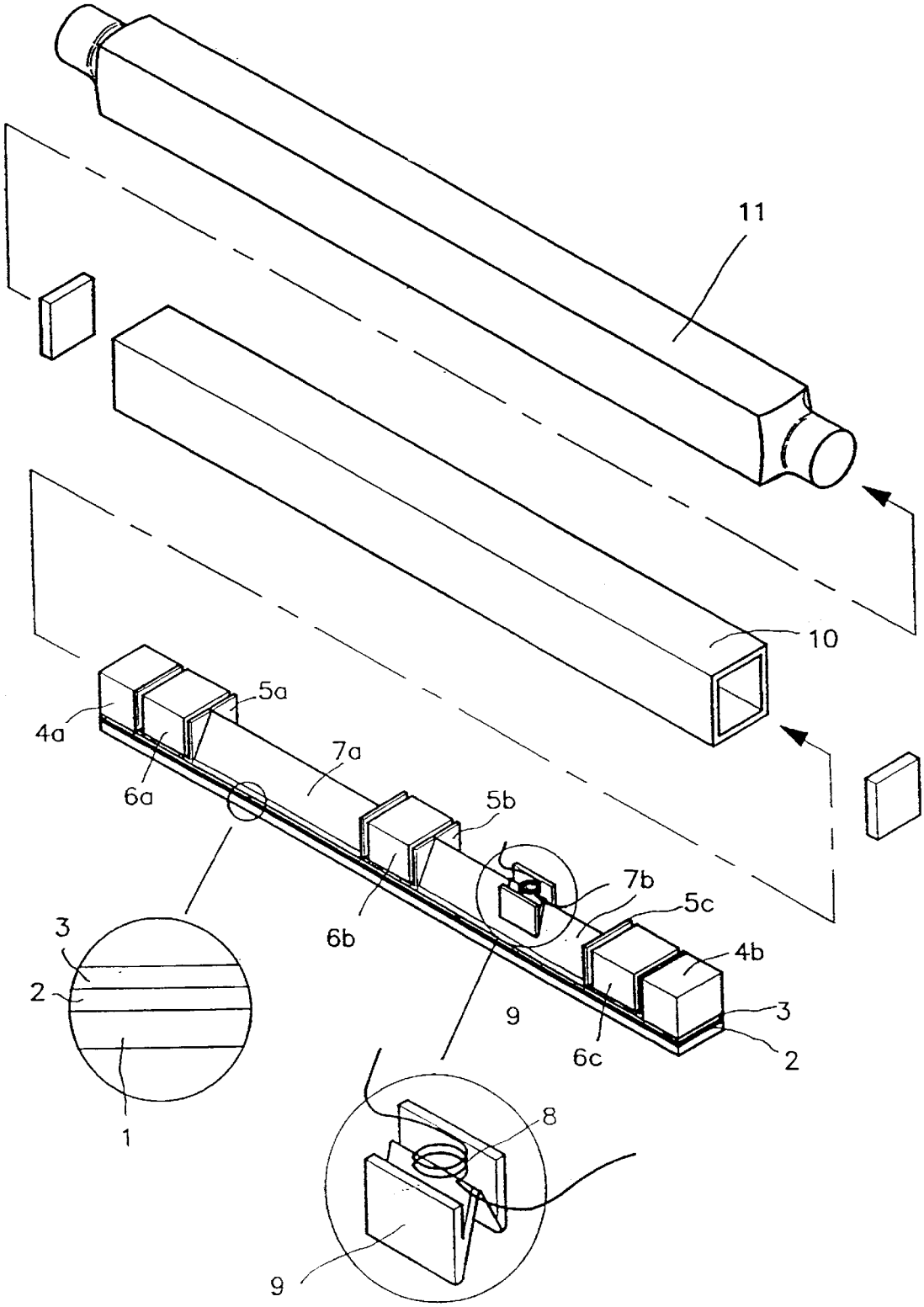
FIG. 4*a* is an exploded perspective view illustrating the structure of a device for reducing toxic wastes of diesel fuel according to this invention.
Figure 4B:
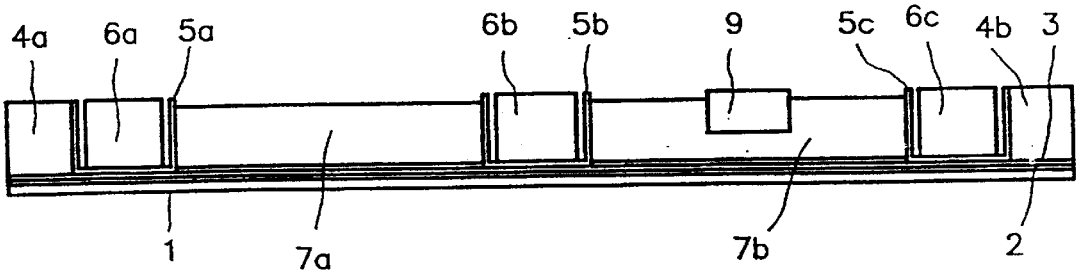
FIG. 4*b* is a side view of internal structure illustrated in FIG. 4*a;*
Figure 4C:
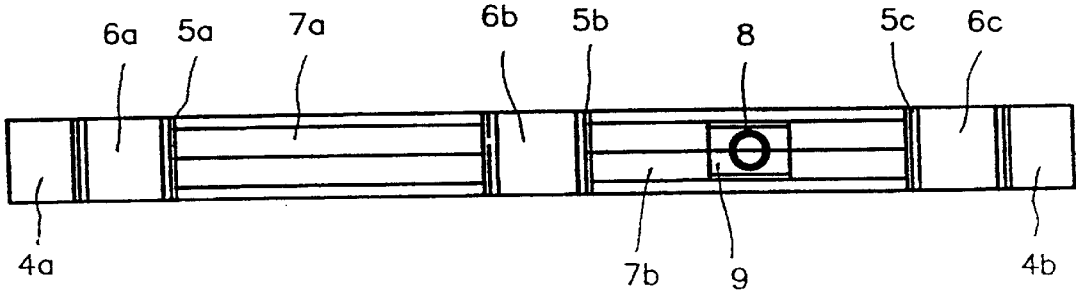
FIG. 4*c* is a plan view of internal structure illustrated in FIG. 4*a;*

This invention relates to a device illustrated in FIG. 4*a*, FIG. 4*b* and FIG. 4*c*. As shown in FIGS. 4*a*, 4*b* and 4*c*, the device of this invention has a structure, wherein left and right rubber sealants 4*a*, 4*b* are attached on a rubber body 1, a copper sheet 2 having the same width as rubber body 1 is attached on rubber body 1, and an aluminum sheet 3 is again attached on the upper side of copper sheet 2. Further, magnetic induction pins 5*a*, 5*b*, 5*c*, each having a U-shaped channel, are attached to the left and right sides and center on the body 1. Eternal magnets or electromagnets 6*a*, 6*b*, 6*c* are attached on their respective bottom sides to body 1 and between the legs of U-shaped channel of the magnetic induction pins 5*a*, 5*b*, 5*c*, respectively, while an insulator is inserted into pin wheel portions of insulator at both side. Each ceramic triangle pole 7*a*, 7*b* having a narrower base than the aluminum sheet 3 is inserted between the left and right magnetic induction pins 5*a*, 5*c* and magnetic induction pin 5*b* located at the very center, and attached on the aluminum sheet 3. Hence, the ceramic triangle poles 7*a*, 7*b* have a structure illustrated in FIG. 5.

In particular, according to this invention, the electromagnetic wave induction pin 9 is attached on the very center of the right-side ceramic triangle pole 7*b*, which is inserted between right-side magnetic induction pin 5*c* and very centered magnetic induction pin 5*b*. Induction pin 9 may be attached to either one of the ceramic triangle poles 7*a*, 7*b*. Hence, both wheels are formed in the electromagnetic wave induction pin 9 and the coil 8 is arranged within the induction pin 9. As shown in FIG. 4*a*, the structure, so formed, is inserted into the square aluminum pipe 10 and sealed therein. Thus, its whole outer cover is coated with the insulator 11.

The device of this invention may be mounted to a hose or pipe serving as a feed port to supply diesel fuel to a diesel engine via fuel tank of a diesel internal combustion engine. The device of this invention functions as a pre-treatment device designed for reducing toxic wastes of diesel fuel, which may be, prior to use, attached to the surface side of a hose or pipe located at place being possibly adjacent to a fuel tank without damaging, cutting or removing it.

The device of this invention is intended for use in some automobiles of high-speed diesel engine consuming diesel fuel including mid- and low-speed internal combustion engines. The device is attached to the surface side of a hose or pipe connected at place being possibly adjacent to a fuel tank serving as a fuel feed. When diesel fuel is fired from the internal combustion engine, the device of this invention may provide best combustion conditions for nearly perfect combustion. In particular, a principle of electromagnetic regulation applied in this invention is that, diesel fuel can be properly controlled before the fuel flows to an engine. The device consistent with this principle can prevent the release of soot particles such as hydrocarbon mixture (some hydrocarbons are adsorbed to carbon particles), sulfur- and aerosols-based compounds as well as polluting gases (e.g., CO, HC, NOx and Sox) soots, and toxic wastes in the form of solid particle substance, together with exhaust gas. With such fabrication, the molecular structure and activity of diesel fuel is improved before entering the air intake hole and fuel feed hose or pipe, thus enabling the pretreated diesel fuel to have nearly perfect combustion within a diesel engine. Hence, a pre-treatment device refers to the device based on a physicochemical method designed for regulating the release of toxic substances before a fuel is injected into an internal combustion engine. In contrast, its corresponding post-treatment device refers to the device in which solid soot particles in particular are filtered off among toxic substances released from the firing of an internal combustion engine or incinerated for other heat sources.

As explained in the process of forming the soot above, there is an increasing trend to release the soot according to the order of small to large density of fuel molecules, i.e., in the sequential order of paraffin, naphthene and aromatic series. Therefore, such an increasing trend will be noticeable from a direct chain structure of carbon, to hydrogen structure, and to a cyclic-ring structure. This means that when hydrogen is isolated at the stable position where double-bonded carbons exist, its original molecular structure maintains as it is. In this respect, to degrade more stable ring-type carbon group into smaller groups, more energy to degrade such structure should be necessary except for compression heat source.

With this in mind, the inventor understands that carbon atoms absorb a lot of extreme infrared wave radiated at the well oxidized temperature. Thus, the mechanism of this invention is that by providing the specific heat of extreme infrared having the same wavelength as the wavelength of liquid-phase hydrocarbons in diesel fuel, carbon atoms are caused to go under resonance motion prior to combustion of diesel fuel, thus reacting with oxygen atoms.

As such, when hydrogen and carbon atoms of this invention have certain levels of electromotive force, they become sensitive to the outside or electromagnetic wave irrespective of the viscosity and temperature of liquid-phase hydrocarbons. To utilize this, it is necessary that an electromotive force of liquid-phase hydrocarbons should be first generated and, at the same time, an external electromagnetic wave should cause the liquid-phase hydrocarbons to resonate.

Further, to let the liquid-phase hydrocarbons have an electromotive force, the first method is to stabilize static current or various wavelengths generated from an internal combustion engine structure due to various causes via discharge or elimination. Under such stable state, the hydrocarbons may stably receive a necessary electromotive force and energy wave which may enable resonance to occur.

Further, in order to instantaneously let the liquid-phase hydrocarbons have an electromotive force necessary for active molecular movement, diesel fuel should be transferred from low magnetic field to higher magnetic band.

To this end, one pole, either N-pole or S-pole, should be continuously selected and moved rapidly at a constant 90° angle towards the direction of magnetic speed in a magnetic field. A hose or pipe where diesel fuel moves towards an engine is the best material in maintaining such movement direction and speed. In selecting the best place to meet such object, the inside of an engine room is unsuitable and if possible, it is advantageous to select the place, being far from an engine room with a lot of electronic control circuits. Thus, the place adjacent to diesel fuel pipe connected to a fuel tank is suitable.

Figure 6:
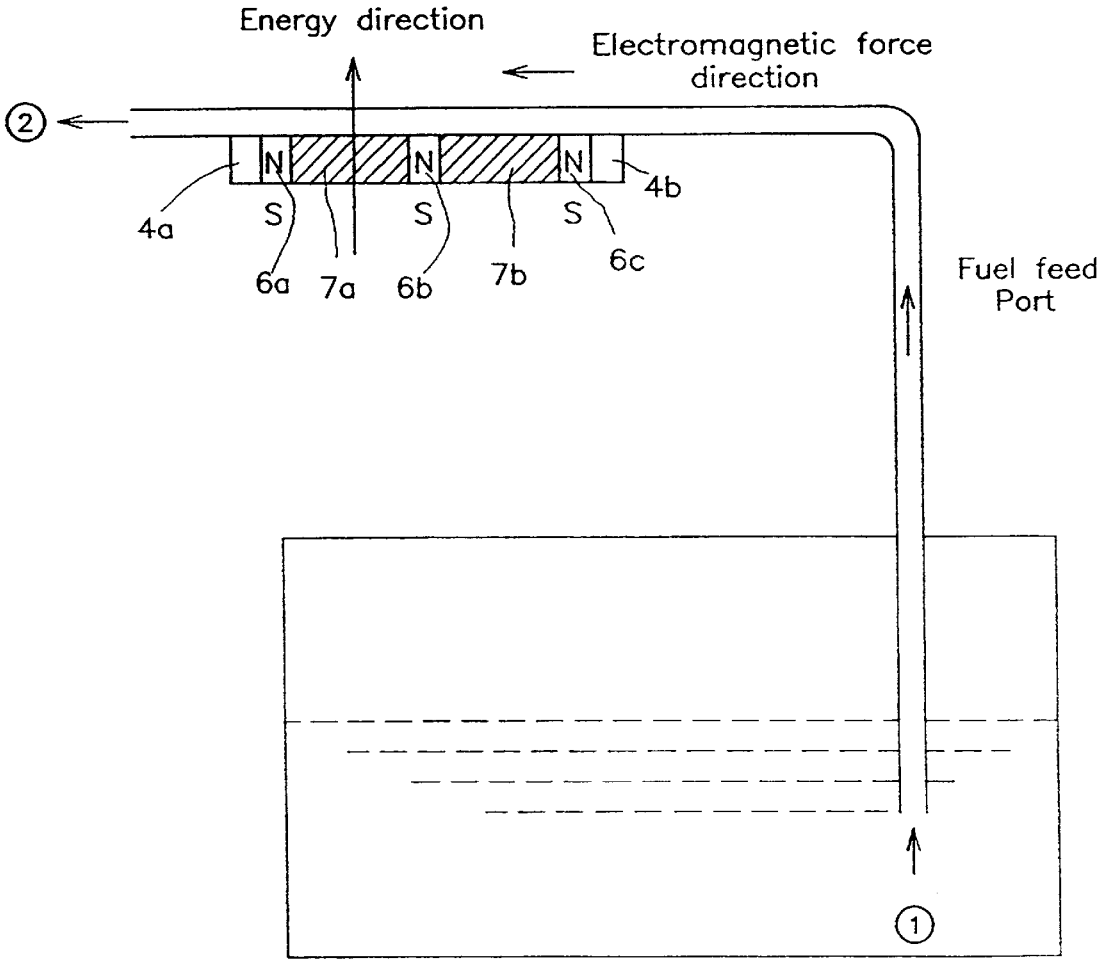
FIG. 6 is a concept diagram in which the device of this invention is attached to a fuel feed port.

FIG. 6 is a diagram in which the device of this invention is attached to a fuel feed port. Since each of magnet 6*a* (0.22 wb/ $m^2$), magnet 6*b* (0.21 wb/ $m^2$) and magnet 6*c* (0.2 wb/ $m^2$) is arranged at constant intervals to a fuel pipe which flows into an engine, diesel fuel flowing from the direction of (1) to (2) moves on N pole of magnet 6*c* to magnet 6*b* to magnet 6*a* at 90° angle.

Hence, there are some different electromotive forces in diesel fuel due to size, material and flow rate of a pipe but within the allowable magnetic speed in a magnetic field scope of 8 cm in diameter, a desired electromotive force may be obtained. Referring to FIG. 6, the liquid-phase hydrocarbons have an electromotive force when they are passed through each point of three magnets 6*a*, 6*b*, 6*c*. Then, when a low frequency electromagnetic wave is discharged to the hydrocarbons, they will perform the resonance motion.

Figure 5:
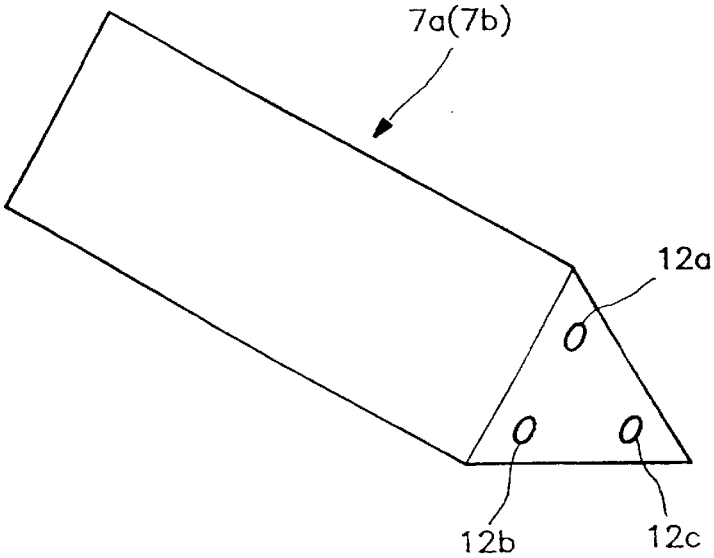
FIG. 5 is a perspective view showing the structure of ceramic triangle pole illustrated in FIG. 4*a;*
Figure 7A:
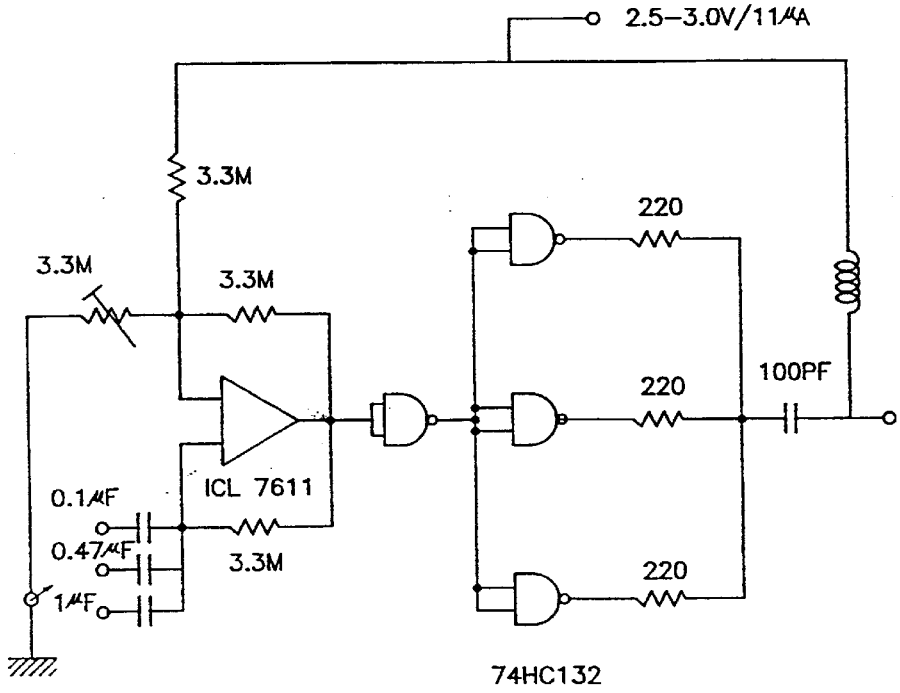
FIG. 7*a* is a circuit diagram in which the device of this invention is attached to a fuel feed port of a diesel internal combustion engine.

Further, ceramic triangle poles 7*a*, 7*b*, each of channel-section magnetic induction pins 5*a*, 5*b*, 5*c*, illustrated in FIG. 5, and some components of the device of this invention, generate an electromagnetic wave in the form of a magnetic wave, having the same wavelength as extreme infrared wave, i.e., a low frequency wavelength of 8~20 Hz. Hence, the electromagnetic wave is 2.53 V/11 $\mu$A. When such components of the device of this invention are installed on a fuel feed port, the circuit structure related to electromagnetic wave and its generation is illustrated in FIG. 7*a*. The magnetic induction pins 5*a*, 5*b*, 5*c* are induced to generate electromagnetic wave having the same wavelength as the diesel fuel, i.e., at 10~18 Hz, to cause a resonance. In particular, among diesel fuel passing on the band of the ceramic triangle poles 7*a*, 7*b*, since carbon atoms are induced, then hydrogen atoms are under resonance with the wavelength of ceramic which has specific heat of extreme infrared wave at 8~20 Hz.

In the meantime, the materials for magnets 6*a*, 6*b*, 6*c* used in the device of this invention include $Nd_2Fe_{14}B$, a casting bed of Nd-Fe-B alloy and other materials equivalent to $Nd_2Fe_{14}B$. Seventy two (72) atoms are contained in the unit of sachet and it is preferred to use the materials consisting of a Fe-layer only and/or of either Nd- or B-layer in the sequential order. The ultramagnet containing neodymium-iron as a material is applied within a special electromagnetic wave when grounded, thus generating the electromotive force suitable for the molecular structure of liquid-phase hydrocarbons.

Further, the common ceramic materials may be used for the fabrication of the ceramic triangle poles 7*a*, 7*b* of this invention and in particular, it is preferred to use Al-Si-Ca-Na-K-Ti series. For example, the preferred chemical composition comprises $Al_2O_3$ 42%, $SiO_2$ 31%, Ca 10%, NaO 7%, $K_2O$ 3%, $TiO_2$ 3% and other rare earth element 3~5%. Also, the ceramic triangle pole is a mixture having the particle size of 1~10 $\mu$m, and a final product plasticized at the temperature between 1,200~1,300° C. may be used. Three straight-through holes 12*a*, 12*b*, and 12*c* provided at both triangular sides are formed within the ceramic triangle poles 7*a*, 7*b*. This fabrication allows both nonferrous and ferrous alloy poles to be installed in straight-through holes 12*a*, 12*b*, and 12*c*. From a section of the triangle poles 7*a*, 7*b*, its hole size to a triangle leg is preferably determined as 9:2. Two neodymium iron poles and a pole of aluminum 99.4% which is not grounded by the vaporization force-induced electromagnetic wave, are formed within straight-through holes 12*a*, 12*b*, and 12*c* and serve to control the electromagnetic wave generated by the triangle poles 7*a*, 7*b*.

Further, each ceramic triangle pole 7*a*, 7*b* is fabricated in such a manner that the electromagnetic wave emitted by its triangle pole is directed upward toward the N-pole (as shown in FIG. 6 by the arrow of energy direction). Then, in case of the electromagnetic wave induction pin 9 containing coil 8, one side is contacted with one of the ceramic triangle poles 7*a*, 7*b*, and comprises 18K gold of about 0.01~0.1 mm, while the opposite symmetrical side comprises copper of more than 99.4%. Thus, ionic charges moving from the base of the triangle poles 7*a*, 7*b* to the ring direction are absorbed and along with the wave length generated from the circuit diagram illustrated in FIG. 7*b*, electromagnetic waves are emitted towards N-pole. Hence, the electromagnetic wave has its wave length of merely 2.5~3.0 V/81 $\mu$A but its strong impact on carbon atoms activates diesel fuel.

The following principles apply when diesel fuel consists of hydrocarbon structure where carbon and hydrogen molecules are bonded. A proper combustion requires a predetermined mixture of carbon and oxygen. To supply a proper amount of oxygen in highly compressed intake air, oxygen before air intake should be provided with some activation energy under full understanding of its nature. Then, for freed carbons not to be solidified by each other, the reaction between carbon and oxygen should be further induced for proper combustion. To provide such conditions, an abundance of oxygen molecules should be provided to compensate for an active portion of which reacting with hydrogen molecules to make water ($H_2O$). If such proper controlling method is available, it is preferred to fully utilize the physicochemical nature of both oxygen and carbon, under the assumption that some causes to generate the solid particle substances of carbon may be prevented.

As such, air in intake hole 21 is preferably activated along with the activation of diesel fuel in the fuel feed port where the device of this invention is installed. To this end, a coil 31 is provided in the air intake hole 21 for supplying a separate pulse wave. When air is inhaled, oxygen resonates to an electromagnetic wave of 8,000~20,000 Hz generated from a circuit diagram illustrated in FIG. 7*b*. In consequence, when carbon atoms in diesel fuel oxidize, the significant reactability may improve the combustion efficiency.

In line with a correlation between such fuel and suction oxygen, some problems associated with viscosity and shortening of ignition lag in diesel fuel as well as formation of soot thereof are related to each other, as aforementioned. Therefore, to overcome these problems, it is necessary to consider the nature of carbon. In general, when the liquid-phase hydrocarbons are preheated, there is a trend that, due to its chemical structure, its viscosity is lowered.

The liquid-phase diesel fuel, when injected into a diesel engine, should have viscosity to facilitate delivery into a cylinder. Then, diesel fuel within a cylinder is oxidized in the process of particulation and atomization. When excess of oxygen exists, the soot is instantaneously generated. Such phenomenon is derived from the nature of carbon atom. When the rotary transition motion of hydrogen atoms is active, however, carbon atoms in diesel fuel has a nature of adhering to hydrogen atoms until particulated dispersion. Through the utilization of such characteristics, the hydrocarbons are atomized into particles and during the heating process from the surface pocket of its fuel particles, carbon atoms are isolated from the hydrocarbon structure. Then, with the ignition lag shortened, carbon atoms are easily oxidized by oxygen atoms within a cylinder having an excessive amount of air. On the other hand, hydrogen atoms serve until the rotary transition motion is decreased resulting in shortened ignition lag.

Also, some compressed heat energy should be necessary for the oxidation of carbon atoms with oxygen atoms. From the characteristics of diesel, its heat of vaporization amounting to 250~300 KJ/kg is relatively small and thus, the vaporization rate is fast. Thus, in the process of particulating and vaporizing diesel fuel, widening the surface pocket area of fuel particles as much as possible means that it widens the space to react with oxygen, i.e., to widen the reacting band. In case carbon atoms have the electromotive force, they are liable to reject the adhesion among them, reflecting a process of making solid particle substances among carbon particles. Therefore, the following process steps from activation of liquid-phase hydrocarbon in diesel fuel to release of exhaust gas and wastes should be necessary: fuel, generation of electromotive force, induction of resonance movement by electromagnetic wave, injection, vaporization (widening of surface pocket area by particulation of diesel fuel, i.e., expansion of reaction band with oxygen, ignition, explosion, and release. In case of the vaporization during the above process steps, the state of compressed air intake at high temperature should be considered and during the air intake, whether 21% oxygen is present in air, should be also checked.

Figure 8:
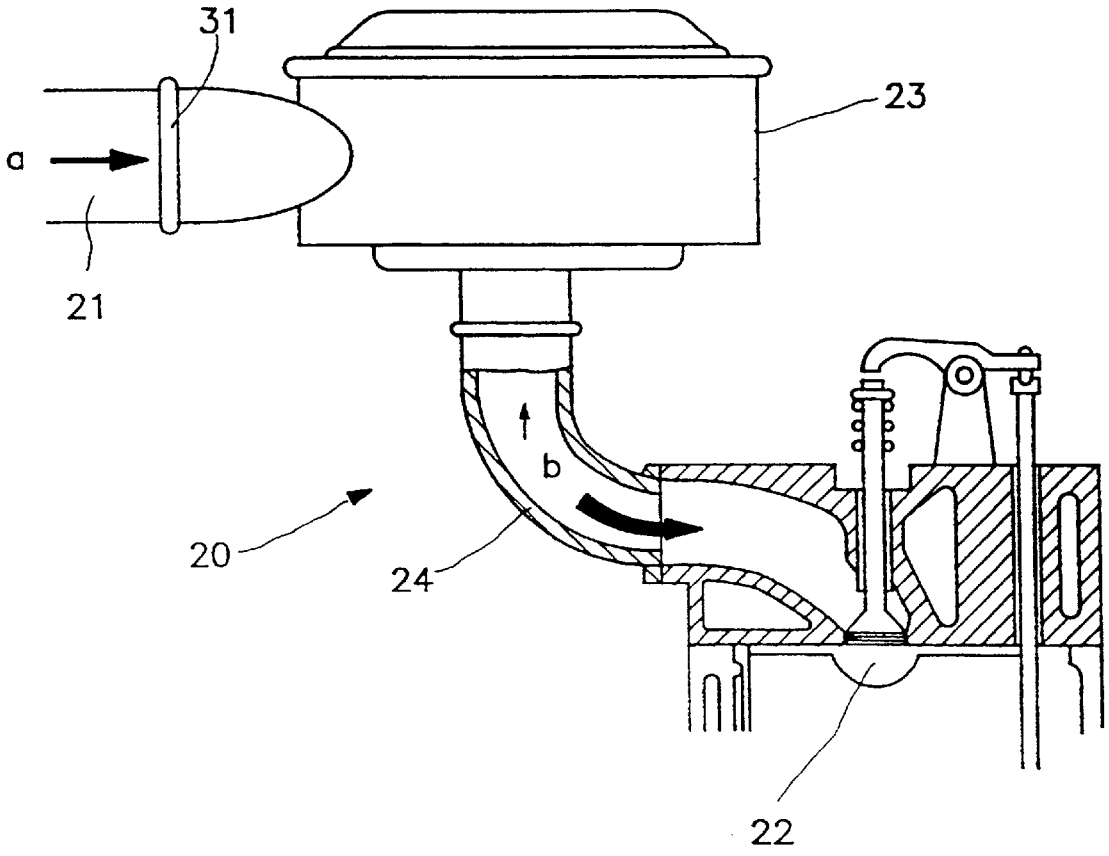
FIG. 8 is a cross-sectional structure diagram showing a portion of air-sucked from diesel engine.

As shown in an air intake portion illustrated in FIG. 8, when the air is inhaled or taken in via an air intake hole 21 in the atmosphere consisting of 21% oxygen and 78% nitrogen, compressed air should be swirled so as to maintain the even distribution of 21% oxygen. Even though oxygen atoms are compressed at higher temperature, oxygen atoms should be ready for active diffusion within the cylinder or combustion chamber 22.

According to the device of this invention, therefore, there is provided a coil 31 at "a" point of the air intake portion 20 illustrated in FIG. 8 for mutual use thereof. Thus, the action of pulse wave emitted by a circuit illustrated in FIG. 7*b* activates the inhaled air within combustion chamber or cylinder 22. Oxygen atoms in the inhaled air induces the perfect combustion of diesel fuel in such a manner that hydrogen and carbon atoms present in diesel fuel are reduced or oxidized into water and carbon dioxide, thus providing an efficient combustion conditions for both diesel fuel and inhaled oxygen.

Figure 7B:
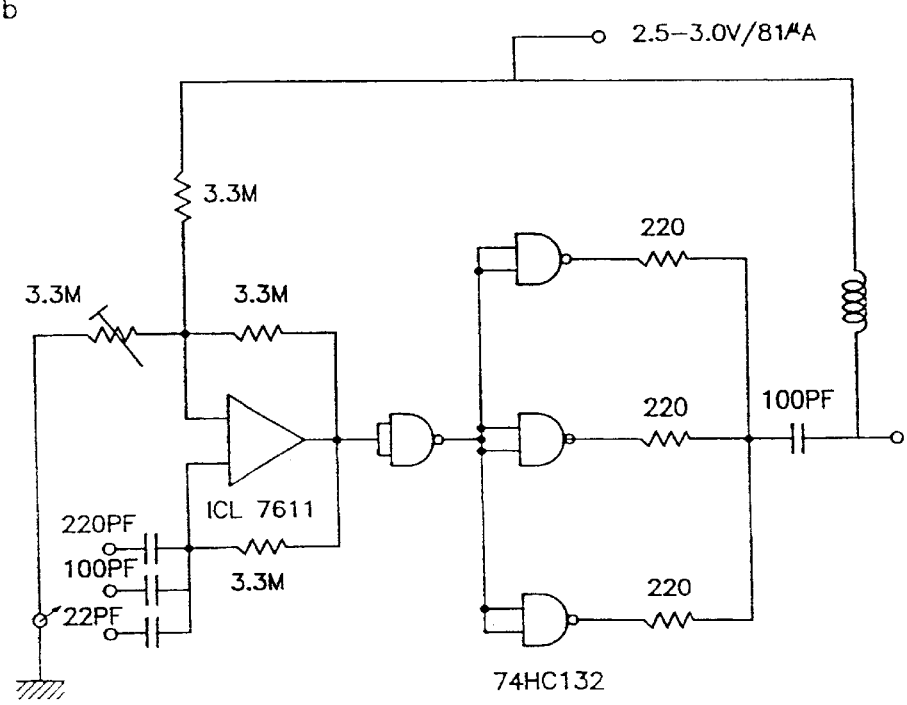
FIG. 7*b* is a circuit diagram in which a pulse-generation electromagnetic wave is supplied from an air-suction portion sucked by a diesel internal combustion engine.

As shown in FIG. 7*b*, the circuit generating a pulse electromagnetic wave has a capacity of 2.5~3.0 V/81 $\mu$A and may vary at 2,000~20,000 Hz. When oxygen is freed from hydrogen in the vaporizing state of hydrocarbon structure, it reacts with the pulse electromagnetic wave facilitating the activity of oxygen atoms necessary for the perfect combustion of diesel oil, being degraciated into water ($H_3O$,OH—) and carbon dioxide ($CO_2$). This reaction subdues the reaction between oxygen and nitrogen at the high temperature of 700° C. Further, oxygen and nitrogen atoms, being different in nature from each other, remain stable in air, but their intrinsic nature at high temperature may be maintained after the impact by the electromagnetic wave having the same pulse wave. Namely, under the compressed state at high temperature, oxygen and nitrogen atoms can have time-controlling force so that the generation of nitrogen oxide may be inhibited within a cylinder.

Further, when a swirling phenomenon of inhaled air occurs at point "b" illustrated in FIG. 8 before intaking the external air to the combustion chamber 22, such swirling action induced by inhaled air compressed at high temperature may serve to expand the reaction band between carbon and hydrogen atoms having the activation conditions in diesel fuel up to the near perfect combustion, even though air is inhaled into the combustion chamber 22. Also, such swirling phenomenon is maintained by a pulse electromagnetic wave oxygen generated from point "a" illustrated in FIG. 8.

In consequence, the activity of oxygen atoms are restricted under high temperature and high-pressure of cylinder, even though the swirling phenomenon occurs at point "b" illustrated in FIG. 8 by the physical (mechanical) method. According to this invention, a pulse electromagnetic wave is generated at point "a" illustrated in FIG. 8 by the method of applying some kinetic energy to oxygen atoms themselves in order to overcome such restriction and provide the kinetic energy to oxygen atoms in the inhaled air, thus accomplishing the perfect combustion.

As such, according to the device of this invention, the coil 8 installed within the electronic induction pin 9, being connected to a power supply (non-illustrated) in a common method, has a circuit structure illustrated in FIG. 7*a*. The coil 8 activates diesel oil by generating an electromagnetic wave. In addition to such device of this invention, the coil 31 generating a pulse wave can simply be installed in the air intake hole 21 where air is inhaled for combustion of diesel fuel. When the generation of magnetic pulse wave is induced by way of FIG. 7*b*, oxygen atoms in the air inhaled before air intake is, prior to passing an air filter, provided with some kinetic energy by the pulse wave in the air intake hole 21. The activated oxygen atoms contribute much to the activation of diesel fuel and inhaled air, thus obtaining a synergic effect to maximize the combustion efficiency.

Several tests were performed so as to measure the combustion states of actual diesel fuel, its release of toxic wastes, based on the aforementioned device including a circuit of this invention, and the result of attaching the device of this invention to a diesel automobile. From the following table 1, it was measured that the device of this invention significantly reduced some toxic exhaust gas and toxic wastes in the form of solid particle substances, while showing very encourging and remarkable combustion efficiency.

TABLE 1

Measurement results of exhaust gas and toxic wastes

| Testing item | Conc. of exhaust gas (CVS) | | | | | | Soot conc. Of non-loading speed | |
|---|---|---|---|---|---|---|---|---|
| | CO(g/km) | | HC(g/km) | | NOx(g/km) | | | |
| Automaker | F | G | F | G | F | G | F | G |
| Before using the device of this invention | 0.34 | 0.40 | 0.09 | 0.10 | 0.7 | 0.8 | 39 | 43 |
| After using the device of this invention | 0.01 | 0.02 | 0.01 | 0.01 | 0.4 | 0.5 | 8 | 10 |
| Accumulated driving after using the device of this invention | 0.01 | 0.02 | 0.01 | 0.02 | 0.3 | 0.3 | 7.6 | 9 |
| Releasing rate of exhaust gas and toxic wastes | 96 | 95 | 99 | 98 | 50 | 45 | 83 | 80 |

Note
1: Concentration of exhaust gas: measured by CVS computer. From Table 1, the soot values in CVS were mean values measured by CVS computer devices, photo-reflection and spot collection-type soot tester, generally used in the testing organizations all over the world.
2: Since engines per automobile make are different, the selection criteria of vehicles were as follows: vehicles, within 3 years from the factory, having the mileage of 50,000 km. Two vehicles of 2,500 cc level with diesel engine were compared and their mean values were calculated.

TABLE 1-continued

| Measurement results of exhaust gas and toxic wastes | | | | | | | | |
|---|---|---|---|---|---|---|---|---|
| | Conc. of exhaust gas (CVS) | | | | | | Soot conc. Of non-loading speed | |
| Testing item | CO(g/km) | | HC(g/km) | | NOx(g/km) | | | |
| Automaker | F | G | F | G | F | G | F | G |

3: The values shown in Table 1 were mean values calculated from both the measurement for one month 5 times prior to the attachment of the device of this invention and the measurement for one-month use of the device 5 times.

As mentioned in the foregoing, the device of this invention is very easily attached, prior to use, to an internal combustion engine of diesel fuel from the outside, and does not inflict any damage to a fuel feed engine, when used.

Further, the device of this invention may maximize the performance efficiency by the method of simultaneously activating oxygen in the air suction hole and with combustion efficienty near to perfect combustion, the device of this invention may reduce the formation of toxic substances as well fuel consumption.

Therefore, the device of this invention is an ideal device to comply with the toxic wastes of an internal combustion engine, thus reducing air pollution associated with hydrocarbon fuels and having further energy-saving effects based on perfect combustion.

What is claimed is:

1. A device for installation adjacent a combustion chamber of a diesel-fueled engine to reduce toxic waste in the engine exhaust, the device comprising:

an assembly including:

an elongated base formed of a layer of copper sheet sandwiched between a bottom layer of rubber sheet and a top layer of aluminum sheet;

a rubber sealant attached to the top layer at each opposed end of the base;

a plurality of magnetic induction pins attached to the top layer of the base, one pin being disposed proximate each rubber sealant and another pin being disposed substantially midway therebetween;

a magnet disposed within each induction pin;

a ceramic pole having a triangular cross section attached to the base between each opposed pair of the induction pins;

an electromagnetic wave induction pin attached to an apex of at least one of the ceramic poles proximate a longitudinal center thereof; and a housing sealingly enclosing and insulating the assembly.

2. The device of claim 1, wherein the plurality of magnets include three magnets, each having a magnetic force of 0.22 $wb/m^2$, 0.21 $wb/m^2$, and 0.2 $wb/m^2$.

3. The device of claim 1, wherein said ceramic poles comprise a chemical composition of approximately $Al_2O_3$ 42%, $SiO_2$ 31%, Ca 10%, NaO 7%, $K_2O$ 3%, $TiO_2$ 3% and rare earth element 3~5% by weight.

4. The device of claim 1 or 3, wherein each ceramic pole further comprises:

three straight-through holes formed on the triangular surface on both ends of said ceramic pole;

two neodymium iron poles and an aluminum pole being inserted within the three straight-through holes.

5. The device of claim 1, wherein one side of said electromagnetic wave induction pin contacted with one of the ceramic pole comprises a coating of 18K gold, while an opposite symmetrical side thereof comprises a copper coating.

6. The device of claim 1 or 5, wherein the electromagnetic wave induction pin has a wavelength of 2.5~3.0 V/11 $\mu$A.

7. A method for reducing toxic wastes of an engine which consumes a diesel fuel by improving a molecular structure and activity of the diesel fuel, comprising the steps of:

providing a specific heat of extreme infrared wavelength having the same wavelength as liquid-phase hydrocarbons of the diesel fuel;

generating an electromotive force of the liquid-phase hydrocarbons to activate a molecular movement of the diesel fuel, and simultaneously inducing an electromagnetic wave in the diesel fuel to cause the liquid-phase hydrocarbons to resonate;

transferring the diesel fuel from a low to a high magnetic field; and performing a resonance motion by discharging a low frequency electromagnetic wave to the hydrocarbons.

8. The method of claim 7, wherein the electromagnetic wave of the performing step has a wavelength range of 2.5–3.0 V/81 $\mu$A.

9. A method for pretreating a diesel-fuel in a fuel feed port of a diesel engine prior to entering a combustion chamber, comprising the steps of:

providing a specific heat of extreme infrared wavelength having the same wavelength as liquid-phase hydrocarbons in the diesel fuel to generate an electromotive force of the liquid-phase hydrocarbons;

generating an electromagnetic wave to cause the liquid-phased hydrocarbons to resonate; and performing a resonance motion by discharging a low frequency electromagnetic wave to the hydrocarbons.

* * * * *

UNITED STATES PATENT AND TRADEMARK OFFICE

CERTIFICATE OF CORRECTION

PATENT NO. : 6,178,954 B1
DATED : January 30, 2001
INVENTOR(S) : Sang Keong Kim

It is certified that error appears in the above-identified patent and that said Letters Patent is hereby corrected as shown below:

Column 14,

Line 21, change "2.5 ~ 3.0" to read -- 2.5 - 3.0 --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*